US005456152A

United States Patent [19]

Cusack et al.

[11] Patent Number: 5,456,152

[45] Date of Patent: Oct. 10, 1995

[54] MOUTHPIECE FOR WOODWIND INSTRUMENTS HAVING A RAISED LAY PORTION

[76] Inventors: John F. Cusack, 169 E. Rienstra St., Chula Vista; Gerald H. Finch, 3202 Caminito Quixote, San Diego, both of Calif. 92154

[21] Appl. No.: 195,094

[22] Filed: Feb. 14, 1994

[51] Int. Cl.[6] ..... G10D 9/02

[52] U.S. Cl. ..... 84/383 R

[58] Field of Search ..... 84/383 R, 380 R, 84/382, 383 A, 380 A; D17/13

[56] References Cited

U.S. PATENT DOCUMENTS 1,896,814 2/1933 Gemeinhardt ..... 84/383 R

*Primary Examiner*—Michael L. Gellner

*Assistant Examiner*—Cassandra Spyron

*Attorney, Agent, or Firm*—Brown, Martin, Haller & McClain

[57] ABSTRACT

The top surface of the mouthpiece, the lay, is tapered by creation of a ramped base which increases the angularity of the lay to enhance the anchor position of the reed on the lay. Also formed within the lay is a concavity, located at the approximate center between the highest point of the ramp and the tangent leading to the tip opening. The combination of the ramp and the concavity allows the spacing between the reed and the tip, the tip opening, to be varied. The ligature, which has two screws, uses the rearmost screw for clamping the reed onto the lay near the higher end of the ramp, and the frontmost screw to adjust the gap between the approximate center of the reed and the lay. The increased pressure on the center of the reed causes the tip opening to increase. This increases the resistance of the reed, providing an increased range and changing the vibratory nature of the reed.

17 Claims, 2 Drawing Sheets

MOUTHPIECE FOR WOODWIND INSTRUMENTS HAVING A RAISED LAY PORTION

BACKGROUND OF THE INVENTION

The mouthpiece of a woodwind instrument is an integral part of the acoustic design of the instrument. The precision demands in forming a mouthpiece are quite high. Nonetheless, in spite of the accuracy with which the mouthpieces are made and the general consistency of the material of which they are formed, the fact remains that standardized mouthpieces differ. Out of a batch of a dozen mouthpieces, one or two will be quite obviously better than the others. This results in a trial-and-error approach to matching the mouthpiece to the instrument, while considering the additional variables of the reed and the player's embouchure.

Since different woodwind instruments, e.g., tenor saxophone, bass saxophone, clarinet, bass clarinet, play in different registers, the mouthpiece for each differs. It is necessary to establish oscillations at different frequencies to reach the appropriate range for a given instrument, with the establishment of oscillations governed by the size of the reed and the tip opening, with the tip opening defined as the gap between the bottom of the reed and the mouthpiece tip. Thus, if someone wants to try different woodwinds, especially in the case of a music student who is trying to decide on which mouthpiece he or she will concentrate.

The reed, another source of significant variability in optimizing the playability and tone of a woodwind, is held in place over the lay and extending over the baffle by the ligature, a metal ring which is tightened by two thumb screws.

The mouthpiece is attached to the instrument by inserting the barrel insert into the instrument barrel. A seal is created by covering the insert with joint cork which compresses to provide a tight fit. Often, because of the variability of instruments and mouthpieces, it is necessary to shave off some of the cork in order to fit the mouthpiece into the instrument.

In two patents which have been granted to the present inventors, a stainless steel reed (U.S. Pat. No. 4,979,420, issued Dec. 25, 1990) and a titanium reed (U.S. Pat. No. 5,227,572, issued Jul. 13, 1993) are disclosed which provide practical and cost effective solutions to the extreme variability in quality and lifetime of traditional cane reeds. A typical cane reed varies in quality due to such factors as growing conditions of the cane and age of the plants, among others. It is not unusual to find only three suitable reeds out of a box of twenty, and the player can only use the reed for about 20–30 hours before it breaks down. Besides providing the improved consistency and durability of metal as compared with cane, these reeds have provided a marked improvement in range and ability to reach the lower registers, eliminating the inherent squeaks experienced in some woodwinds, which previously even the most skilled players had accepted as unavoidable. Thus, several of the problems encountered in playing woodwinds have been addressed.

Still, due to the extreme variability in mouthpieces, trial-and-error fitting techniques have been required to match even the metal reeds to different mouthpieces. This problem could be overcome by creating a universal mouthpiece that will fit all woodwinds, and can accommodate both metal and cane reeds without modifying either. Further, a universal mouthpiece could be used in a variety of different woodwind instruments.

BRIEF SUMMARY OF THE INVENTION

It is an advantage of the present invention to provide a universal mouthpiece for woodwind instruments that can be used with either a metal or a cane reed.

In an exemplary embodiment, the mouthpiece for woodwind instruments comprises a hollow, generally cylindrical body which tapers to an off-axis tip, providing an opening over which a reed is attached to generate the oscillation necessary to play the instrument. The barrel connection stock, which inserts into the barrel of the instrument is a cylindrical extension at the end of the mouthpiece opposite the tip. The barrel connection stock has an outer diameter which is smaller than the outer diameter of the body of the mouthpiece and has a plurality of grooves running around its outer circumference, each groove of which is adapted to retain an o-ring to provide a firm fit when the mouthpiece is inserted into the instrument. The top surface of the mouthpiece, the lay, is tapered by creation of a ramped base which increases the angularity of the lay to enhance the anchor position of the reed on the lay. Also formed within the lay is a concavity, located at the approximate center between the highest point of the ramp and the tangent leading to the tip opening. The combination of the ramp and the concavity allows the spacing between the reed and the tip, the tip opening, to be varied. The ligature, which has two screws, uses the rearmost screw for clamping the reed onto the lay near the higher end of the ramp, and the frontmost screw to adjust the gap between the approximate center of the reed and the lay. The increased pressure on the center of the reed causes the tip opening to increase. This increases the resistance of the reed, providing an increased range and changing the vibratory nature of the reed.

In an alternate embodiment, the tone hole in the mouthpiece is eliminated, and a straight-through taper is formed in the bore so that it gradually decreases in diameter from the barrel end to the tip opening. The lay opening is partially occluded, decreasing its length to less than half the length of a standard opening.

BRIEF DESCRIPTION OF THE DRAWINGS

Understanding of the present invention will be facilitated by consideration of the following detailed description of a preferred embodiment of the present invention, taken in conjunction with the accompanying drawings, in which like reference numerals refer to like parts and in which.

DETAILED DESCRIPTION OF A PREFERRED EMBODIMENT

The following detailed description uses relative positions, e.g., top and bottom, or upper and lower, for illustrative purposes only, to coincide with the orientation of the figures. This description should not be taken to indicate that the inventive mouthpiece is limited to operation in such an orientation.

Figure 1:
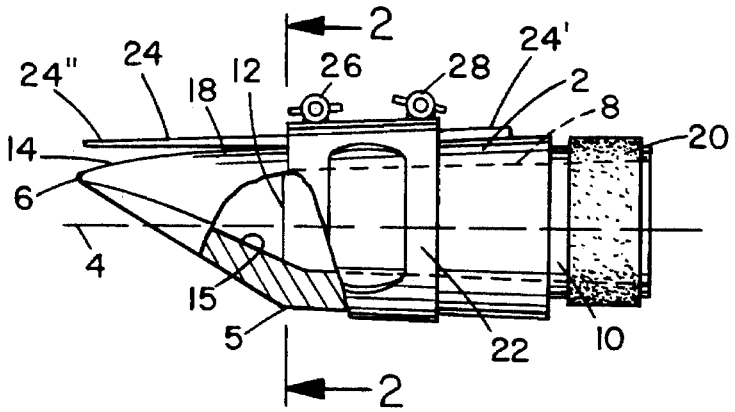
FIG. 1 PRIOR ART
FIG. 1 is a side elevation, partially cut away, of a mouthpiece according to the prior art.
Figure 2:
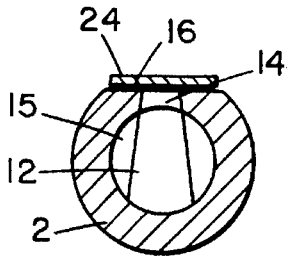
FIG. 2 PRIOR ART
FIG. 2 is a cross-sectional view taken along line 2—2 of FIG. 1.

As illustrated in FIG. 1, the mouthpiece of the prior art comprises a body 2 which is generally cylindrical with reference axis 4 running through its center. The body gently tapers from its back end toward point 5 at a 2 degree slope (relative to axis 4), then tapers at an approximate 30 degree angle to tip 6 which is off-center with respect to axis 4. The bore 8 which runs through body 2 has a constant diameter from barrel stock 10 up to the tone hole 12, at which point it narrows to a rectangular shape with the same width as the innermost width of the lay opening 14, as can be seen in FIG. 2. This relatively abrupt transition, occurring at a point corresponding to taper point 5, creates the tone chamber within which a resonance is established by the player. The lay opening 14 becomes slightly wider as it progresses toward the tip 6, exposing the baffle 15. Lay 16 is a flattened surface on top of the body which runs generally from the rearmost portion of the body 2 to the tangent 18, at which point the top surface curves slightly downward toward the tip 6. The tangent 18 is located near the lengthwise center of the lay opening 14.

The barrel stock 10 has an outer diameter which is smaller than that of the body 2 and slightly smaller than the inner diameter of the barrel of the instrument (not shown). A cork strip 20 is glued onto the outer surface of barrel stock 10 to provide a seal when the mouthpiece is inserted into the instrument.

The reed is attached by first sliding the ligature 22 over the body 2, then inserting the base end 24' of reed 24 between the ligature 22 and the lay 16. Both screws 26 and 28 are tightened to hold the reed in place. The spacing between the tip 6 and the tip end 24"of reed 24, the tip opening, is then fixed.

Figure 3:
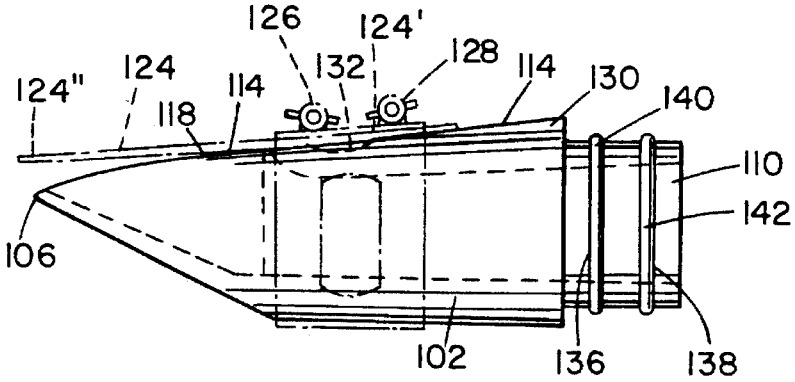
FIG. 3 is a side elevation of a first embodiment of the present invention.
Figure 4:
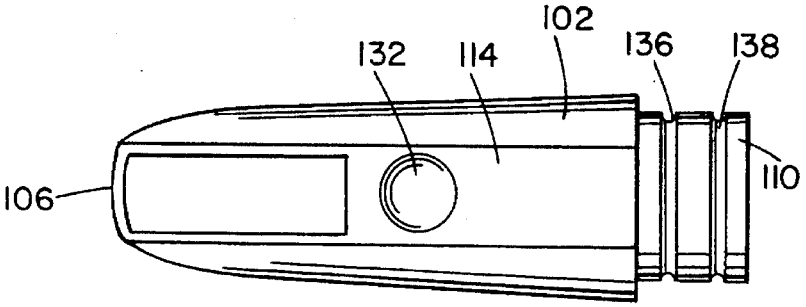
FIG. 4 is a top view of the first embodiment of the present invention.

In the first embodiment of the present invention illustrated in FIG. 3, the body 102 is formed much like that of the mouthpiece of the prior art, shown in FIGS. 1 and 2, with a cylindrical body tapering to an off-axis tip 106. However, at the rearmost portion of the body 102 at the barrel end, with a first diameter which is the largest diameter of the body, a ramp 130 is built so that it extends above the circumference of the cylinder to provide larger angle in the lay 114. The ramp effectively increases the diameter of the body beyond the first diameter of the cylindrical body alone. The ramp 130 has an exaggerated slope of 7 (degrees) compared to the 2 degree slope of the prior art. This enhances the anchor position of the reed 124 on the lay 114. The ramp 130 extends to the tangent 118 at which the cylindrical body 102 has a second diameter smaller than the first diameter. At the approximate center of the lay 114 between the highest point of the ramp 130 and the tangent 118 is a concavity 132. The combination of the concavity 132 and the ramp 130 permit the adjustment of the tip opening by simply varying the amount of pressure placed on the reed 124 by the frontmost screw 126 of the ligature 122 (which is drawn with a dashed line to allow the details of the mouthpiece to be seen clearly). The rearmost screw 128 anchors the base 124' of reed 124 in place on the lay 114. By tightening the frontmost screw 126, the ligature puts pressure on the center of the reed 124 which overlies the concavity 132. This, in turn, causes the tip end 124" of the reed 124 to flex outward, increasing its resistance. The resistance of the reed can then be changed by adjusting the amount of pressure applied by the frontmost screw 126, allowing the player to adapt the reed to his or her own playing style and ability, and desired range, or permit the use of the mouthpiece on a different woodwind instrument which requires a different size tip opening.

While the use of a metal reed with the inventive mouthpiece is preferred, this design may also be used with a cane reed to provide significant improvement and lessen sensitivity to the variances that are encountered in reed quality, and can also be used with plastic and other synthetic reeds.

The barrel stock insert 110 of the inventive mouthpiece has a diameter smaller than the first diameter of the body and two or more grooves 136 and 138 formed therein into which o-rings 140 and 142, or other types of seal rings, are placed. The o-rings, which are commonly available in neoprene or similar material, fit tightly within the grooves and have an outer diameter to fit tightly within the barrel of the instrument. This improvement allows different size o-rings to be used to adapt to different size instrument barrels so that the cork in the prior art mouthpieces does not need to be cut to fit. In addition, the o-rings are more tolerant to repeated removal from and replacement into the instrument barrel. If an o-ring should break down, it is much easier to replace than the cork which must be scraped off, then new cork glued on the barrel stock.

Figure 5:
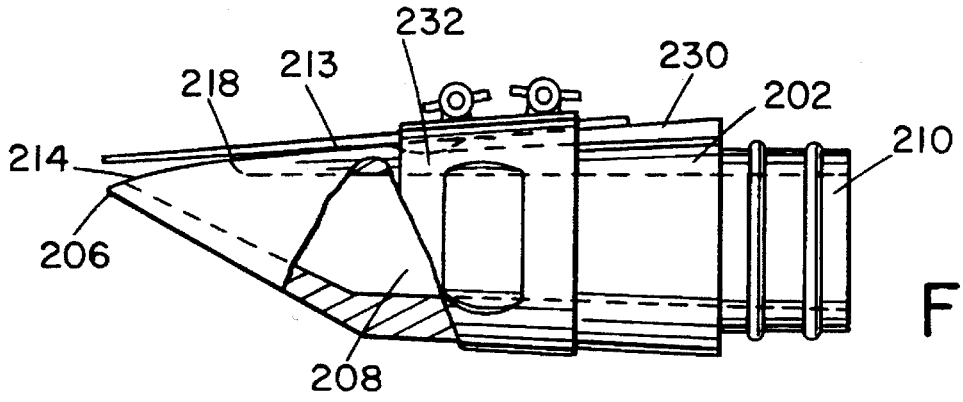
FIG. 5 is a side elevation, partially cut away, of a second embodiment of the present invention.
Figure 6:
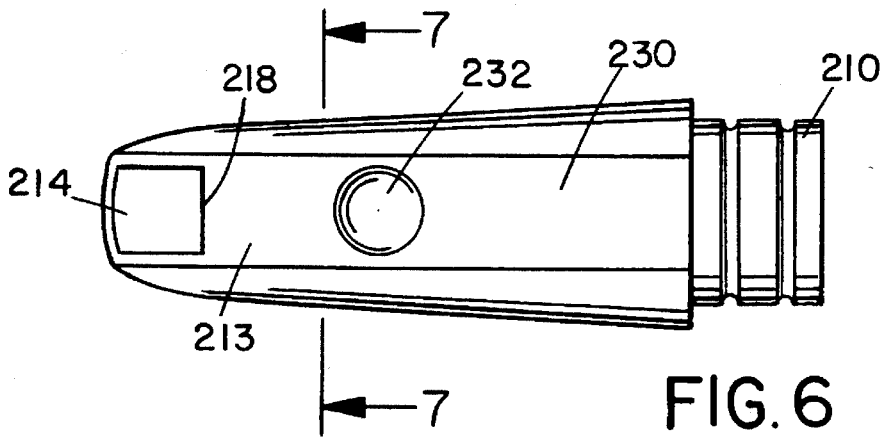
FIG. 6 is a top view of the second embodiment of the present invention.
Figure 7:
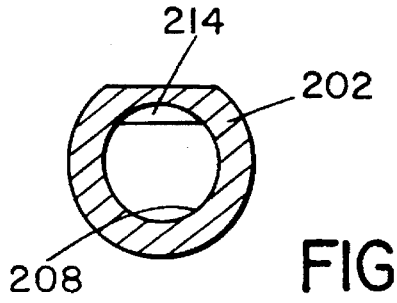
FIG. 7 is a cross-sectional view taken along line 7—7 of FIG. 6.

In the second embodiment illustrated in FIGS. 5, 6 and 7, additional improvements include the omission of the tone hole and the partial occlusion of the lay opening.

As can be seen in FIG. 5, the general external structure of the body 202 of the mouthpiece is the same as that of the first embodiment, with ramp 230 and concavity 232. However, the top view in FIG. 6 clearly shows the difference in the size of the lay opening 214, with an occlusion 213 formed from the tangent 218 back toward rear of the mouthpiece, resulting in more than half of the lay opening being closed as illustrated, compared to the first embodiment. The actual amount of the lay opening that will be occluded depends upon the location of the tangent relative to the tip.

In the second embodiment, the bore 208 is not constant, but varies in a smooth taper, decreasing gradually in diameter from the barrel stock 210 to the tip 206. The abrupt change in diameter introduced by the tone hole of the prior art is eliminated, thus eliminating the tone chamber as defined by the prior art.

The material of which the mouthpiece of the present invention is made does not differ from that of the prior art. An epoxy material or ebonite is used. Similarly, the ligature is the same as those currently in use.

It will be evident that there are additional embodiments and applications which are not disclosed in the detailed description but which clearly fall within the scope and spirit of the present invention. The specification is, therefore, not intended to be limiting, and the scope of the invention is to be limited only by the following claims.

We claim:

1. An improved mouthpiece for a woodwind instrument for use in combination with a ligature having a front screw and a rear screw and a reed having a tip end and a base end, the mouthpiece having a slowly tapering cylindrical body having a first diameter and a lengthwise bore running therethrough, said body having a tip end and a barrel end, a barrel stock insert adjacent said barrel end, a lay comprising a flattened surface on a top of said slowly tapering cylindrical body running from said barrel end to a tangent where said top of said slowly tapering cylindrical body curves downward, and a lay opening disposed in said lay, wherein said ligature encircles a portion of said body and said base end of said reed and thereby retains said base end of said reed against a portion of said lay so that said tip end of said reed is held at a fixed position with respect to said tip end of said body to define a tip opening between said tip end of said reed and said tip end of said body, and wherein said barrel stock insert has an external diameter smaller than said first diameter, said external diameter being adapted to fit within a barrel of said woodwind instrument, the improvement comprising:

a ramp formed on said lay, said ramp being raised above said first diameter at said barrel end and sloping downward to said tangent; and a concavity formed in said lay at a lengthwise center of said ramp;

wherein said reed is held in place on said ramp by said rear screw of said ligature and said front screw of said ligature is adapted for varying pressure applied to said reed above said concavity whereby said tip opening may be varied.

2. An improved mouthpiece as in claim 1 further comprising:

a plurality of circumferential grooves formed in said barrel stock insert; and a seal ring disposed in each of said circumferential grooves, each of said seal rings having an outer diameter to closely fit within said barrel of said woodwind instrument.

3. An improved mouthpiece as in claim 1 wherein said lay opening extends from said tip end to said tangent.

4. An improved mouthpiece as in claim 1 wherein said bore is smoothly tapered from said barrel end to said tip end.

5. An improved mouthpiece as in claim 1 wherein said slowly tapering cylindrical body tapers upward from a taper point to said tip end off-axis with respect to a center axis of said slowly tapering cylindrical body.

6. A mouthpiece for a woodwind instrument on which a reed is retained by a ligature having a front screw and a rear screw, the mouthpiece comprising:

a generally cylindrical body having a top surface, at least a portion of which curves downward, a bottom surface, at least a portion of which tapers upward, a barrel end and a tip end, said generally cylindrical body having a first taper and a second taper, said first taper decreasing from a first diameter at said barrel end to a second diameter at a taper point on said bottom surface between said barrel end and said tip end, and said second taper in said bottom surface decreasing upward from said taper point to said tip end;

a bore running through said cylindrical body having a decreasing bore diameter from said barrel end to said taper point;

a flattened ramp formed on said top surface of said cylindrical body, said flattened ramp having a length running from said barrel end to a tangent point at said portion of said top surface which curves downward, said flattened ramp having a first height above said top surface of said barrel end and sloping downward to a second height substantially level with said second diameter and a concavity formed at a lengthwise center of said flattened ramp;

a lay opening in said top surface extending inward from said tip end;

a barrel stock insert adjacent said barrel end having an outer diameter smaller than said first diameter and smaller than an inner diameter of a barrel of said woodwind instrument for insertion into said barrel;

wherein said reed is retained on said ramp by said rear screw of said ligature and a tip opening between said tip end and said reed is varied by adjusting said front screw to force a center point of said reed into said concavity.

7. A mouthpiece as in claim 6 further comprising:

a plurality of circumferential grooves formed in said barrel stock insert; and a seal ring disposed in each said circumferential groove, said seal ring having an outer diameter to closely fit within said barrel of said woodwind instrument.

8. A mouthpiece as in claim 6 wherein said lay opening extends from said tip end to said tangent.

9. A mouthpiece as in claim 6 wherein said lay opening extends from said tip end to a point on said lay diametrically opposite said taper point.

10. A mouthpiece as in claim 6 wherein said bore is smoothly tapered from said barrel end to said tip end.

11. A mouthpiece as in claim 6 wherein said bore is tapered from said barrel end to a point in said bore corresponding to said taper point at which said point a tone hole is formed.

12. A mouthpiece as in claim 6 wherein said second taper runs off-axis from an axis running through a center of said cylindrical body.

13. A mouthpiece for wind instruments, said mouthpiece having a lay on which a reed is retained by a ligature which encircles said mouthpiece and said reed, said mouthpiece comprising:

a generally cylindrical body having a bore therethrough, a tip end, a barrel end opposite said tip end, a flattened top surface, a bottom surface, a taper point on said bottom surface between said tip end and said barrel end, a barrel stock insert adjacent said barrel end and a lay opening in said flattened top surface adjacent said tip end, said body being slowly tapered with a first diameter at said barrel end and a second diameter at said taper point, said second diameter being smaller than said first diameter, wherein said flattened top surface is divided at a tangent point between said tip end and said barrel end into a lay portion and a tip portion, said tip portion having a downward curvature; and a ramp formed in said lay portion of said top surface, said ramp having a first end adjacent said barrel end of said body and a second end at said tangent point, said first end of said ramp being raised above said first diameter.

14. A mouthpiece as in claim 13 further comprising a concavity disposed in said ramp substantially at a center point between said first end and said second end.

15. A mouthpiece as in claim 13 wherein said lay opening extends from said tip end to said tangent point.

16. A mouthpiece as in claim 13 wherein said lay opening extends from said tip end to a point on said top surface diametrically opposite said taper point.

17. A mouthpiece as in claim 13 wherein said bore is smoothly tapered from said barrel end to said tip end.

* * * * *